US005180246A

United States Patent [19]

Hightower

[11] Patent Number: 5,180,246

[45] Date of Patent: Jan. 19, 1993

[54] BINDING SYSTEM

[76] Inventor: Greg A. Hightower, P.O. Box 369, Wayne, Ill. 60184

[21] Appl. No.: 701,203

[22] Filed: May 16, 1991

[51] Int. Cl.[5] ..... B42F 3/02

[52] U.S. Cl. ..... 402/20; 402/80 R; 402/80 P

[58] Field of Search ..... 402/20, 80 R, 80 P

[56] References Cited

U.S. PATENT DOCUMENTS

| | | | |
|---|---|---|---|
| 2,246,702 | 6/1941 | Stewart | 402/20 |
| 2,314,204 | 3/1943 | Fontecilla | 402/20 |
| 2,421,404 | 6/1947 | Anderskow | 402/20 |
| 5,028,159 | 7/1991 | Amrich et al. | 402/20 |

FOREIGN PATENT DOCUMENTS

| | | | |
|---|---|---|---|
| 949872 | 2/1964 | United Kingdom | 402/20 |

OTHER PUBLICATIONS

City Office Supply Corporation office supply catalog, pp. 840 and 841, 1990.

A page from a GBC Catalog, 1990.

*Primary Examiner*—Paul A. Bell

*Attorney, Agent, or Firm*—Willian Brinks Olds Hofer Gilson & Lione

[57] ABSTRACT

A binder useful for containing articles that have holes located near the edge of the article. The binder has a plurality of spaced apart oppositely located ribs attached to either side of a hinge that pass through the holes when the binder is in a closed position to securely contain the articles.

14 Claims, 2 Drawing Sheets

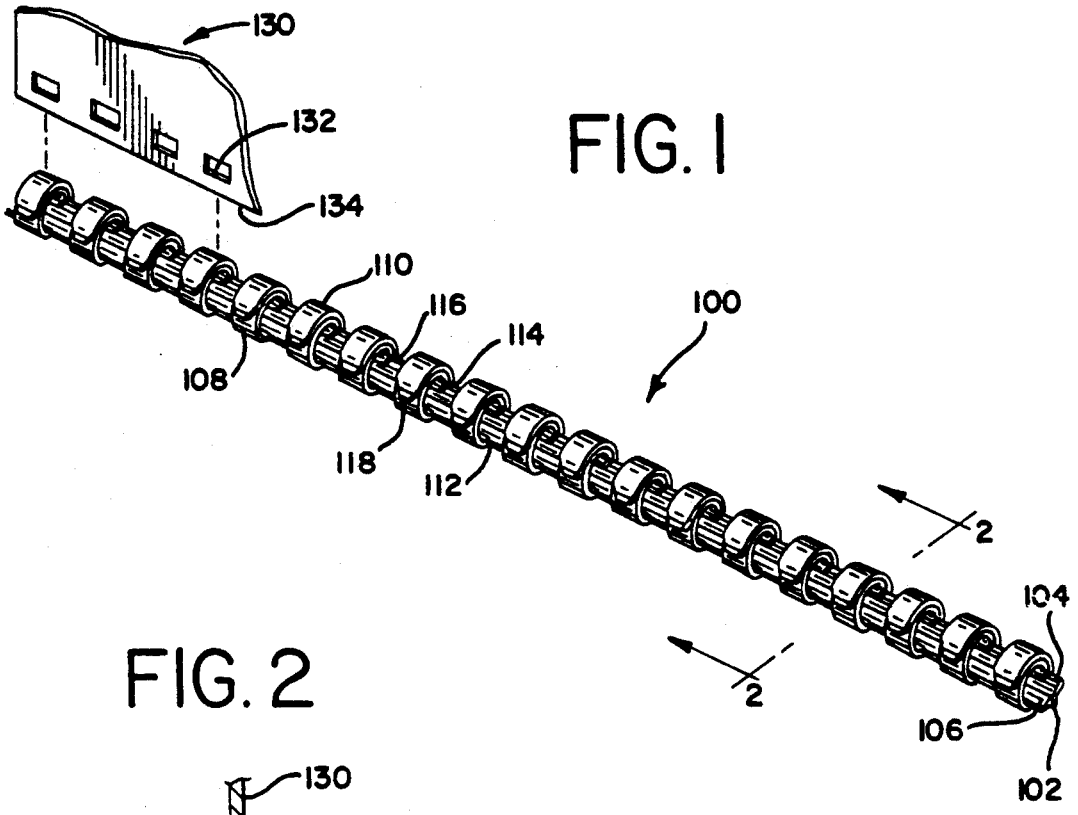
FIG. 1
FIG. 2
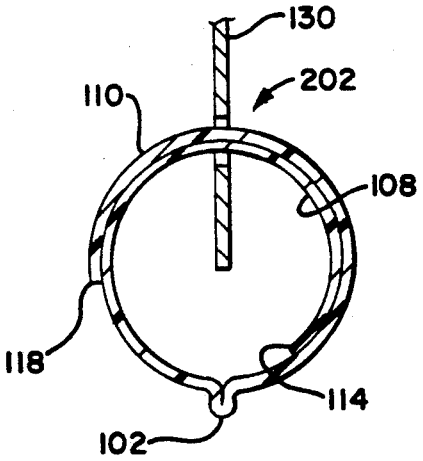
FIG. 3
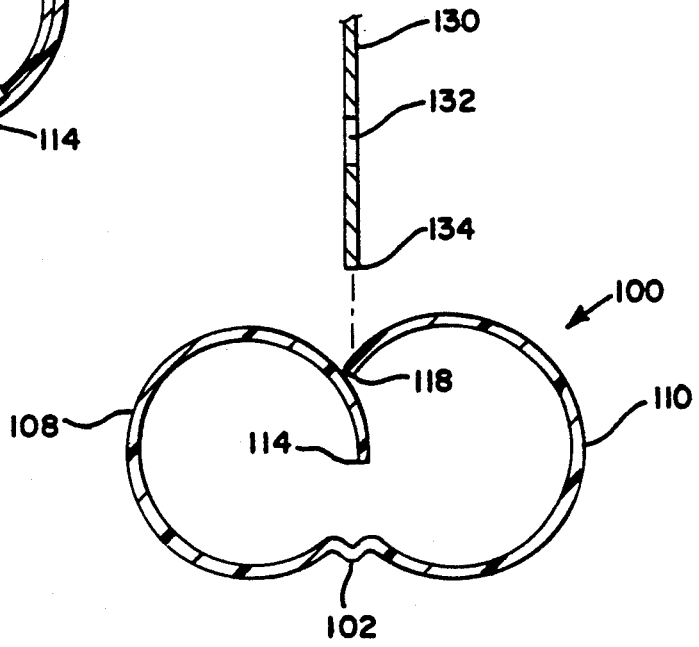

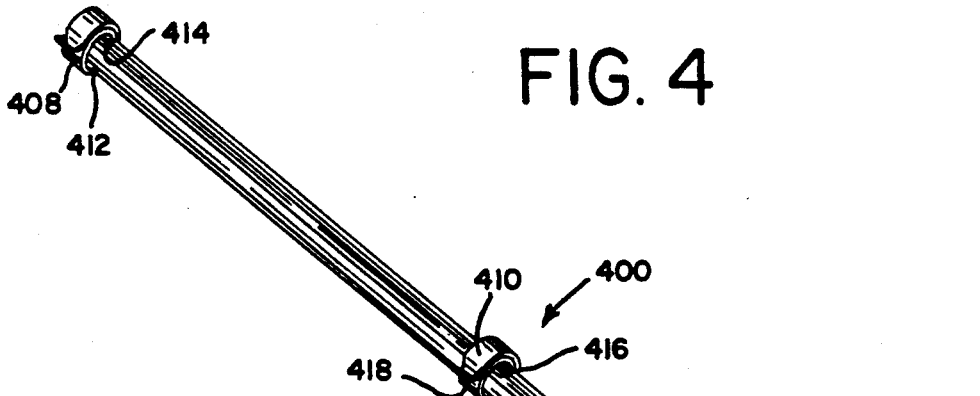
FIG. 4
FIG. 5
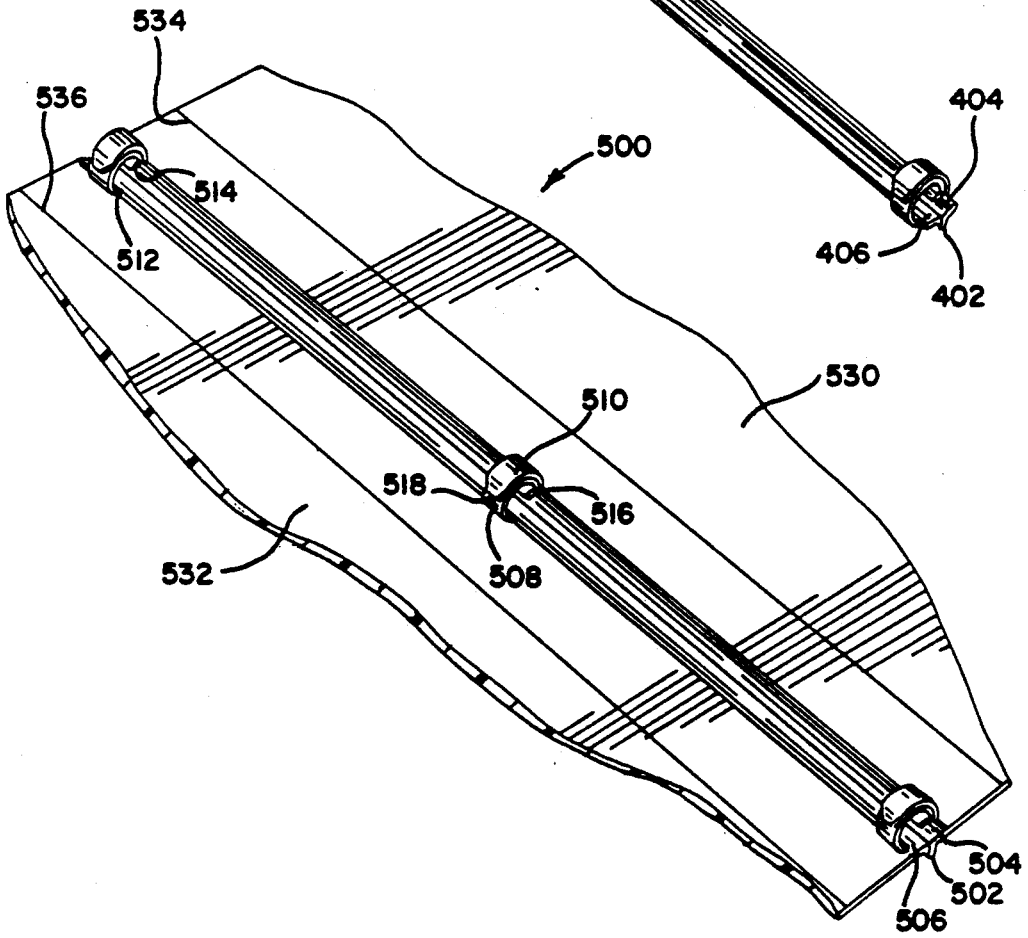

BINDING SYSTEM

BACKGROUND OF THE INVENTION

The present invention relates to a binder that is useful in containing articles, for example, paper, that have holes located near its edge.

Generally, there are two types of binders available to contain articles. The first is the well-known three-ring binder which is commonly used by students. This type of binder has a spine and two covers with each cover hinged at the edge of the spine. Typically, the spine and covers are made of cardboard covered by plastic.

The binder has three rings that may be opened and closed and typically are part of a mechanism that permits the user to open all three rings merely by pulling apart one ring. The mechanism also permits the user to close all three rings merely by pushing together one ring. Thus, when the rings are opened, a portion of each ring can be guided through holes in the article so that the article is contained when the rings are closed. Usually, the rings and the mechanism are made of metal with the mechanism attached to the spine by, for example, rivets.

The advantage with this type of binder is that it is easy to insert or remove articles. The user need only turn to the location where the article is to be removed or inserted, pull apart the rings, remove or insert the article, and close the rings.

However, the problem with this type of binder is that it is rigid and therefore bulky and hard to carry and store. Moreover, this type of binder is expensive to produce because the ring mechanism and rings are made of metal.

The second type of binder is generally a binder molded from plastic. This type of binder has a plastic spine of any suitable width depending on the number of articles to be contained. Molded to one edge of the spine are several ribs. The distal end of the ribs curl inwardly toward the opposite edge of the spine. To contain articles, the user places the binder into a particular machine which straightens the ribs so that the holes in the articles can be aligned with the ribs. After each article has been inserted onto the ribs, the user releases the machine which allows the ribs to resume their curled position due to their plasticity.

The advantage with this type of binder is that it is lightweight, flexible, and easy to carry. In addition, it is cheaper than the typical three ring binder.

However, a problem with this type of binder is that it is very difficult to remove or insert new articles. The user must have the particular machine, which can be costly, to straighten the ribs so that an article can be inserted or removed.

The present invention solves the problems of these types of binders by providing a binder, preferably formed of plastic, that allows the user to easily insert and remove articles without the bulk and rigidity of the typical three ring binder. Moreover, the present invention provides a binder that is easy to manufacture. This will result in a binder that has a lower cost than the three ring binder while providing the advantages of those types of binders.

SUMMARY OF THE INVENTION

The invention provides a binder for containing articles that have holes located near the edges of the article. The binder has a hinge with two hinge extensions. Attached to one hinge extension is a first plurality of spaced apart ribs. Attached to the other hinge extension is a second plurality of spaced apart ribs. The second plurality of ribs are opposite to and correspond in location with the first plurality of ribs. When the hinge is open the articles may be fitted over one plurality of ribs, and when the hinge is closed, the two pluralities of ribs cooperatively associate with each other to secure the article.

BRIEF DESCRIPTION OF THE DRAWINGS

FIG. 1 is a perspective view of a binder according to one embodiment of the invention.

FIG. 2 is a cross section of the binder of FIG. 1 taken along line 2—2 of FIG. 1 with the binder in a closed position.

FIG. 3 is a cross section of the binder of FIG. 1 in an open position.

FIG. 4 is a perspective view of a binder according to another embodiment of the invention FIG. 5 is a perspective view of a binder according to another embodiment of the invention.

DETAILED DESCRIPTION OF THE INVENTION AND PREFERRED EMBODIMENTS

FIG. 1 illustrates a preferred embodiment of a binder in a closed position that is useful for containing articles, such as paper, that have holes located near one edge of the article. Although it is understood that many different types of articles such as paper, plastic, and metal articles can be contained using the present invention, the invention will be described by using paper.

The binder 100 has a hinge 102 with two hinge extensions 104 and 106, a first plurality of ribs 108 with a proximal end 112 attached to extension 106, and a distal end 114. The binder 100 also has a second plurality of ribs 110 with a proximal end 116 attached to extension 104 and a distal end 118. When the binder 100 is in a closed position, the first distal end 114 and the second distal end 118 cooperatively associate and pass through holes 132 located near edge 134 of paper 130 to contain or secure the paper.

The hinge 102 can be of any suitable flexible material that allows the ribs 108 and 110 to be pulled to an open position and pushed to a closed position. Preferably, the hinge 102 is made of plastic. More preferably, the hinge 102 is a plastic living hinge, which includes those made of one or more types of a plastic resin and those in which the thickness of the hinge is varied.

As shown in FIG. 1, the hinge 102 preferably has two hinge extensions 104 and 106. The size of the hinge extensions 104 and 106 can vary, typically depending on the number of articles to be contained, although other practical considerations may determine their size. For example, when the number of articles to be contained is small, the hinge extensions 104 and 106 will necessarily be small. Although the hinge extensions 104 and 106, as shown in FIG. 1, have the same size, it is understood that the size of the hinge extension 104 may be the same or different as the size of the hinge extension 106.

A first plurality of ribs 108 is spaced apart along the length of the hinge 102. The ribs 108 have a proximal end 112 and a distal end 114 with the proximal end 112 attached to extension 106. Alternatively, the proximal end 112 may be joined with extension 106. The number of ribs 108 can be varied depending on the size and the amount of the paper to be contained as well as other practical considerations.

Although plastic is preferred, the ribs 108 may be of any suitable material such that the hinge 102 and the ribs 108 and 110 are flexible. Preferably, when the hinge 102, the hinge extensions 104 and 106, and the ribs 108 are made of plastic, the proximal end 112 of the ribs 108 is integrally formed onto the extension 106 by, for example, molding.

A second plurality of ribs 110 is also spaced apart along the length of the hinge 102. The ribs 110 have a proximal end 116 and a distal end 118 with the proximal end 116 attached to the extension 104. Alternatively, the proximal end 116 may be joined with the extension 104. The number of ribs 110 is the same as the number of ribs 108 and thus, the number of ribs 110 correspondingly vary as the number of ribs 108 varies.

As shown in FIG. 1, each of the ribs 110 are opposite to and correspond in location with each of the ribs 108. The ribs 110 may be of any suitable material although plastic is preferred. Preferably, when the hinge 102, the hinge extensions 104 and 106, and the ribs 110 are made of plastic, the proximal end 116 of the ribs 110 is integrally formed onto the extension 104 by, for example, molding. In accordance with the most preferred embodiment, the binder 100, including the hinge 102, the hinge extensions 104 and 106, and the ribs 108 and 110 are made of plastic with the proximal end 112 and 116 molded integral to the extension 106 and 104, respectively.

Preferably, the ribs 108 and 110 are substantially curved. More preferably, the ribs 108 and 110 are substantially semicircular In addition, the ribs may be of any suitable shape such as flat, circular, or any other shape that will pass through a hole 132 in the paper 130.

FIG. 1 shows a binder 100 with nineteen ribs 108 and 110. When paper measuring 8.5 inches by 11 inches is used, it is preferred that there be nineteen ribs 108 and 110. Also, it is preferred that the width of the ribs 108 and 110 be about 0.25 inches and that the space between each rib 108 be the same as the space between each rib 110 which is about 0.3125 inches. These preferred dimensions will increase the binder's compatibility with existing hole punchers.

FIG. 2 shows a binder 100 in a closed position with the paper 130 contained by the ribs 108 and 110 which cooperatively associate and pass through the holes 132. In this embodiment, the ribs 110 are located above the ribs 108. Preferably, the ribs 108 have a length such that the distal end 114 substantially abuts the hinge extension 104 when the binder 100 is in the closed position.

Furthermore, in this embodiment, the ribs 110 have a length such that the distal end 118 is located about halfway between the hinge 102 and a point opposite the hinge 102 indicated as 202. Thus, when the binder 100 is closed, the ribs 110 cooperatively associate and substantially overlap the ribs 108 to help contain the paper 130. Of course it is to be understood that the length of the ribs 110 can be such that the distal end 118 is located anywhere between about point 202 and substantially abutting the extension 106. In addition, the length of the ribs 108 can be such that the distal end 116 is located anywhere between about 202 and substantially abutting the extension 104. It is understood that the length of the ribs 110 and 108 may be substantially the same or they may be different.

FIG. 3 shows the binder 10 in an open position with the paper 130 ready to be inserted into the binder 100. In this embodiment, the length of the ribs 108 are such that the distal end 114 extends beyond the distal end 118. When the binder 100 is moved to a closed position the ribs 108 slide under the ribs 110 because the ribs 108 are longer than the ribs 110. Thus, the ribs 110 substantially overlap the ribs 108.

In operation, the binder 100 can be opened by grasping the ribs 108 and 110 and pulling them apart. When there is a substantial number of ribs 108 and 110, more than one of ribs 108 and 110 may need to be pulled apart to open the entire binder 100. However, not all of the ribs 108 and 110 need to be pulled apart to open the binder 100. When the binder 100 is made of plastic it may also be opened by bending one end of the hinge 102 toward the other end. It is contemplated that other means exist for opening the binder 100. For example, if the binder 100 contains paper, the top two corners of opposite sheets of paper may be pulled in an opposite direction thereby pulling ribs 108 and 110 apart to open the binder.

Thereafter, holes 132, of any suitable shape complementary with the shape of the ribs 108 and 110, in the paper 130, or other articles to be contained, are guided onto either ribs 108 or ribs 110. If the binder 100 having the embodiment shown in FIGS. 1-3 is used, where the ribs 108 are longer than the ribs 110, then the holes 132 are preferably guided onto the ribs 108. The ribs 108 and 110 are then pushed toward each other to close the binder 100. As shown in FIG. 2, when the binder 100 is closed, each of the ribs 108 and 110 cooperatively associate and pass through the holes 132 to securely contain the paper 130.

To insert or remove a paper or papers, the user turns to the location where the paper is to be inserted or removed, opens the binder 100, inserts or removes the paper, and pushes the ribs 108 and 110 together to close the binder.

As described above, the number of ribs 108 and 110 can vary. For example, FIG. 4 shows an alternative embodiment of the invention where binder 400 has three ribs 408 and 410. In this embodiment, the paper 130 need only have three holes 132 and thus, it is compatible with existing paper having three holes.

In this embodiment, the binder 400 has a hinge 402, hinge extensions 404 and 406, with three ribs 408 and three ribs 410. The hinge 402 and hinge extensions 404 and 406 are generally the same as the hinge 102 and hinge extensions 104 and 106 described above.

As shown in FIG. 4, the binder 400 has three ribs 408 that are generally the same as ribs 108 described above. The ribs 108 have a proximal end 412 and a distal end 414 with the proximal end 412 attached to, joined with, or integrally formed onto hinge extension 406 as generally described above for ribs 108. Also, the binder 400 has three ribs 410 opposite to and corresponding in location with each of the ribs 408. The ribs 410 are generally the same as ribs 110 described above. The ribs 410 have a proximal end 416 and a distal end 418 with the proximal end 416 attached to, joined with, or integrally formed into hinge extension 404 as generally described above for ribs 110. Accordingly, it is seen that the embodiment of binder 400 is generally the same as binder 100 except that the binder 400 has only three ribs 408 and 410. Of course, it is understood that the hinder of the present invention can have any number of ribs.

FIG. 5 shows another embodiment of the invention where the binder 500 has two covers 530 and 532 attached to or joined with hinge extensions 504 and 506, respectively, of a hinge 502. Preferably, the covers 530 and 532, the hinge 502, and the hinge extensions 504 and 506 are made of plastic so that the covers 530 and 532 are integrally formed onto the hinge extensions 504 and 506, respectively. In this embodiment, the covers 530 and 532 have a joint 534 and 536, respectively, so that the covers 530 and 532 are able to pivot about their respective joints 534 and 536 to protect papers or other articles inserted in the binder 500.

The binder 500 has ribs 508 and 510. The ribs 508 have a proximal end 512 and a distal end 514 with the proximal end 512 attached to or joined with hinge extension 506. Alternatively, when the hinge extension 506 and the ribs 508 are made of plastic, the proximal end 512 may be integrally formed onto the hinge extension 506.

The ribs 510 have a proximal end 516 and a distal end 518 with the proximal end 516 attached to or joined with hinge extension 504. Alternatively, when the hinge extension 504 and the ribs 510 are made of plastic, the proximal end 516 may be integrally formed onto the hinge extension 504. Alternatively, when the hinge 502, the hinge extensions 504 and 506, and the ribs 508 and 510 are made of plastic, the proximal end 512 and 516 are integrally formed onto the hinge extensions 506 and 504, respectively. In another embodiment, the binder 500, including the covers 530 and 532, the hinge 502, the hinge extensions 504 and 506, and the ribs 508 and 510 are made from plastic the ribs 508 and 510, and the covers 530 and 532 are integrally formed onto the extensions 504 and 506 by, for example, molding.

Of course, it should be understood that a wide range of changes and modification can be made to the embodiments described above. It is therefore intended that the foregoing description illustrates rather than limits this invention, and that it is the following claims, including all equivalents, which define this invention.

I claim:

1. A one piece plastic binder having a generally circular cross section when in a closed position comprising:

a. an elongated section with a living hinge having two hinge extensions;

b. a first plurality of spaced apart ribs, the ribs having a distal end and a proximal end with the proximal end integrally formed onto one hinge extension; and c. a second plurality of spaced apart ribs, the ribs having a distal end and a proximal end with the proximal end integrally formed onto the other hinge extension, the second plurality or ribs being opposite to and corresponding in location with the first plurality of ribs, the second plurality of ribs further having a length such that when the binder is in a closed position, the second plurality of ribs substantially overlap the first plurality of ribs and when the binder is in an open position, the distal end of the second plurality of ribs contacts the first plurality of ribs.

2. The binder of claim 1 where the first plurality of ribs and the second plurality of ribs are substantially semicircular.

3. The binder of claim 1 where the first plurality of ribs and the second plurality of ribs comprise three ribs.

4. The binder of claim 1 where the first plurality of ribs and the second plurality of ribs are made of plastic.

5. The binder of claim 1 where the length of the first plurality of ribs is the same as the length of the second plurality of ribs.

6. The binder of claim 1 where the length of the first plurality of ribs is longer than the length of the second plurality of ribs.

7. The binder of claim 1 where the first plurality of ribs, and the second plurality of ribs are made of plastic, the binder further having a first cover attached to one edge of the hinge and a second cover attached to the other edge of the hinge.

8. A one piece plastic binder, that can be opened and closed so that when the binder is closed it has a generally circular cross section and articles having holes located near one edge of the articles are contained, comprising:

a. an elongated section with a living hinge having two hinge extensions;

b. a first plurality of spaced apart substantially semicircular shaped ribs, the ribs having a distal end and a proximal end with the proximal end integrally formed onto one hinge extension, the first plurality of ribs further having a length such that when the binder is closed the distal end of the ribs substantially abuts the other hinge extension; and c. a second plurality of spaced apart substantially semicircular shaped ribs, the ribs having a distal end and a proximal end with the proximal end integrally formed onto the other hinge extension, the second plurality of ribs being opposite to and corresponding in location with the first plurality of ribs such that when the binder is closed, the second plurality of ribs is above the first plurality of ribs, the second plurality of ribs further having a length such that when the binder is closed the second plurality of ribs substantially overlap the first plurality of ribs and when the binder is in an open position, the distal end of the second plurality of ribs contacts the first plurality of ribs, wherein the binder can be opened by bending one end of the hinge toward the other end of the hinge.

9. A one piece binder comprising:

a. an elongated section with a living hinger having two hinge extensions:

b. a first cover integrally formed onto a first hinge extension and extending substantially the length of the hinge;

c. a second cover integrally formed onto a second hinge extension, the length of the second cover being substantially the same as the first cover;

d. a first plurality of spaced apart ribs, the ribs having a distal end and a proximal end with the proximal end integrally formed onto the first hinge extension; and e. a second plurality of spaced apart ribs, the ribs having a distal end and a proximal end with the proximal end integrally formed onto the second hinge extension, the second plurality of ribs being opposite to and corresponding in location with the first plurality of ribs, wherein the hinge, the hinge extensions and the ribs, when in a closed position, have a generally circular cross section.

10. The binder of claim 9 where the first plurality of ribs and the second plurality of ribs are substantially semicircular.

11. The binder of claim 9 where the first plurality of ribs and the second plurality of ribs comprise three ribs.

12. The binder of claim 9 where the binder, the hinge and the hinge extensions, the first and second plurality of ribs, and the first and second cover are plastic.

13. The binder of claim 9 where the length of the first plurality of ribs is the same as the length of the second plurality of ribs.

14. The binder of claim 9 where the length of the first plurality of ribs is longer than the length of the second plurality of ribs.

* * * * *

UNITED STATES PATENT AND TRADEMARK OFFICE

CERTIFICATE OF CORRECTION

PATENT NO. : 5,180,246
DATED : January 19, 1993
INVENTOR(S) : Greg A. Hightower

It is certified that error appears in the above-indentified patent and that said Letters Patent is hereby corrected as shown below:

In column 3, line 33, after "semicircular" insert --.--.

In column 4, line 64, delete "hinder" and substitute therefor --binder--.

In column 5, line 29, delete "the ribs 508 and 510".

IN THE CLAIMS

Col. 5, claim 1, line 48, before "ribs" delete "or" and substitute therefor --of-.

Col. 6, claim 9, line 35, delete "hinger" and substitute therefore --hinge--; on line 36, after "extensions" delete ":" and substitute therefor --;--.

Signed and Sealed this
Fifth Day of July, 1994

Bruce Lehman

*Attest:*

BRUCE LEHMAN

*Attesting Officer*

*Commissioner of Patents and Trademarks*